US010739706B2

(12) United States Patent
Libster et al.

(10) Patent No.: US 10,739,706 B2
(45) Date of Patent: Aug. 11, 2020

(54) ELECTRICAL DISCHARGE SURFACE TREATMENT

(71) Applicant: HP INDIGO B.V., Amstelveen (NL)

(72) Inventors: Dima Libster, Ness Ziona (IL); Sergey Inotaev, Ness Ziona (IL); Raia Slivniak, Ness Ziona (IL); Eran Shiran, Ness Ziona (IL); Ido Finkelman, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/098,173

(22) PCT Filed: Jul. 20, 2016

(86) PCT No.: PCT/EP2016/067340

§ 371 (c)(1),
(2) Date: Nov. 1, 2018

(87) PCT Pub. No.: WO2018/014957

PCT Pub. Date: Jan. 25, 2018

(65) Prior Publication Data

US 2019/0146381 A1 May 16, 2019

(51) Int. Cl.
*G03G 15/16* (2006.01)
*G03G 15/10* (2006.01)

(52) U.S. Cl.
CPC ..... *G03G 15/161* (2013.01); *G03G 15/10* (2013.01)

(58) Field of Classification Search
CPC .... G03G 15/162; G03G 15/161; G03G 15/10; G03G 15/2039; G03G 15/55; G03G 15/2053; G03G 15/0105; G03G 2215/2038
See application file for complete search history.

(56) References Cited

U.S. PATENT DOCUMENTS

| | | | | |
|---|---|---|---|---|
| 5,119,140 | A | 6/1992 | Berkes et al. | |
| 5,303,014 | A * | 4/1994 | Yu | G03G 15/1685 399/107 |
| 6,256,051 | B1 | 7/2001 | Asada et al. | |
| 8,212,847 | B2 | 7/2012 | Kella et al. | |
| 8,213,845 | B2 | 7/2012 | Herko et al. | |
| 2009/0054576 | A1 * | 2/2009 | Park | G03G 15/161 524/405 |
| 2010/0055602 | A1 * | 3/2010 | Teshima | G03G 9/08755 430/114 |
| 2010/0091335 | A1 | 4/2010 | Sandler et al. | |
| 2011/0293306 | A1 * | 12/2011 | Matsumoto | G03G 15/1605 399/66 |

(Continued)

FOREIGN PATENT DOCUMENTS

EP 0775948 5/1997

OTHER PUBLICATIONS

Corona Treatment—Your Competition's Secret Weapon, <http://www.enerconind.com/treating/library/technical-articles/corona-treatment-your-competitions-secret-weapon.aspx >.

(Continued)

*Primary Examiner* — Susan S Lee

(74) *Attorney, Agent, or Firm* — Fabian VanCott

(57) ABSTRACT

A transfer surface of an intermediate transfer member is treated using an electrical discharge surface treatment. The intermediate transfer member is comprised in a printing apparatus.

20 Claims, 6 Drawing Sheets

(56) References Cited

U.S. PATENT DOCUMENTS

| | | | | |
|---|---|---|---|---|
| 2012/0141157 | A1* | 6/2012 | Pietrantoni | G03G 15/161<br>399/109 |
| 2015/0261144 | A1* | 9/2015 | Sakashita | G03G 15/206<br>399/333 |
| 2016/0083609 | A1* | 3/2016 | Sisler | B41J 2/01<br>347/102 |

OTHER PUBLICATIONS

Zhang, L. et al., Binary Text Image File Preprocessing to Account for Printer Dot Gain, Oct. 27-30, 2014, <http://ieeexplore.ieee.org/xpl/articleDetails.jsp?arnumber=7025534&queryText=dot%20gain&newsearch=true >.

* cited by examiner

500

ELECTRICAL DISCHARGE SURFACE TREATMENT

BACKGROUND

Liquid electrophotographic printing, also referred to as liquid electrostatic printing, uses liquid toner to form images on a print medium. A liquid electrophotographic printer may use digitally controlled lasers to create a latent image in the charged surface of an imaging element such as a photo imaging plate (PIP). In this process, a uniform static electric charge is applied to the photo imaging plate and the lasers dissipate charge in certain areas creating the latent image in the form of an invisible electrostatic charge pattern conforming to one colour separation of the image to be printed. An electrically charged printing substance, in the form of liquid toner, is then applied and attracted to the partially-charged surface of the photo imaging plate, recreating a separation of the image.

In some liquid electrophotographic printers, a transfer member, such as an intermediate transfer member (ITM) is used to transfer developed liquid toner to a print medium. For example, a developed image, comprising liquid toner aligned according to a latent image, may be transferred from the photo imaging plate to a transfer blanket of the intermediate transfer member. From the intermediate transfer member, the toner is transferred to a substrate, which is placed into contact with the transfer blanket.

BRIEF DESCRIPTION OF THE DRAWINGS

Various features of the present disclosure will be apparent from the detailed description which follows, taken in conjunction with the accompanying drawings, which together illustrate features of certain examples, and wherein.

DETAILED DESCRIPTION

Figure 1:
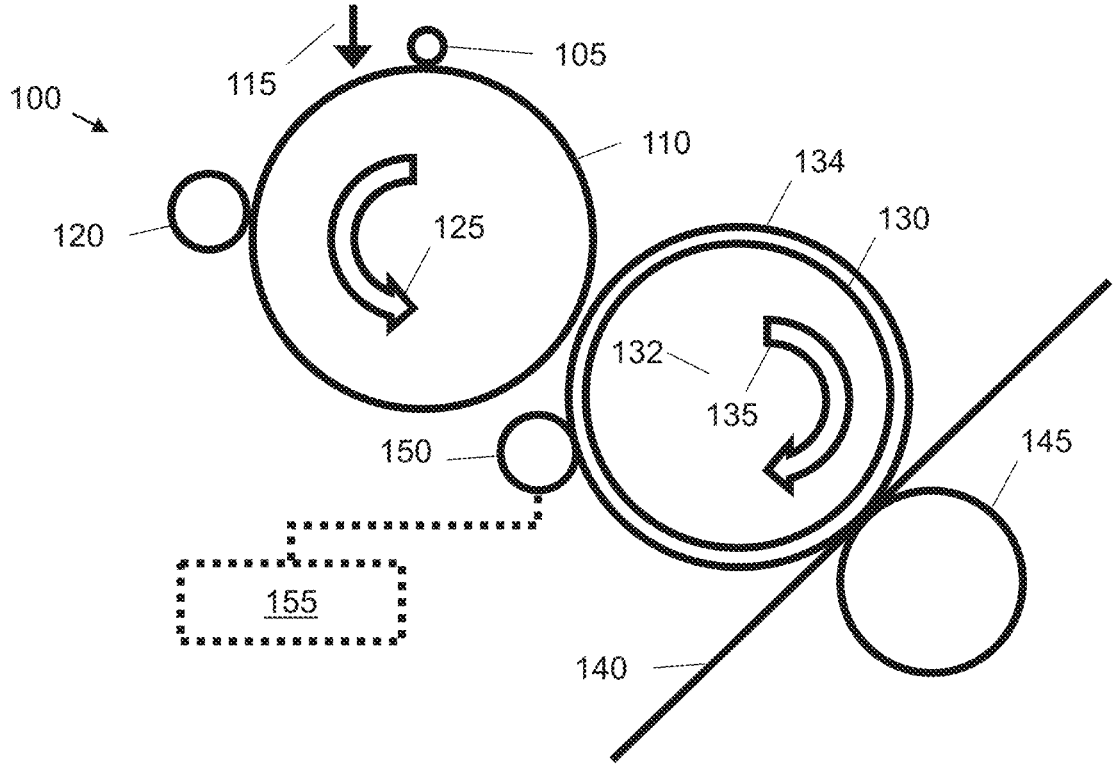
FIG. 1 is a schematic diagram showing a printing apparatus according to an example.

FIG. 1 is a schematic diagram showing a printing apparatus 100. In accordance with this example, the printing apparatus is a liquid electrophotographic printer 100. Liquid electrophotography, sometimes also known as Digital Offset Colour printing, is a process of printing in which liquid toner is applied onto a surface having a pattern of electrostatic charge (i.e. a latent image) to form a pattern of liquid toner corresponding with the electrostatic charge pattern (i.e. an inked image). This pattern of liquid toner is then transferred to at least one intermediate surface, for example a transfer surface of an intermediate transfer member, and then to a print medium. In this example, the transfer surface is a surface via which transfer of liquid toner occurs.

According to the example of FIG. 1, a latent image is formed on a photo imaging plate 110 by rotating a clean, bare segment of the photo imaging plate 110 under a first charging element 105. The photo imaging plate 110 in this example is cylindrical in shape, e.g. is constructed in the form of a drum, and rotates in a direction of arrow 125. The first charging element 105 may include a charging device, such as corona wire, a charge roller, scorotron, or any other charging device. A uniform static charge is deposited on the photo imaging plate 110 by the first charging element 105. As the photo imaging plate 110 continues to rotate, it passes an imaging unit 115 where one or more laser beams dissipate localized charge in selected portions of the photo imaging plate 110 to leave an invisible electrostatic charge pattern that corresponds to the image to be printed, i.e. a latent image. The imaging unit 115 then locally discharges portions of the photo imaging plate 110, resulting in local neutralised regions on the photo imaging plate 110.

In the described example, ink is transferred onto the photo imaging plate 110 by at least one image development unit 120. An image development unit 120 may also be known as a Binary Ink Developer unit. There may be one image development unit 120 for each ink colour. During printing, the appropriate image development unit 120 is engaged with the photo imaging plate 110. The engaged image development unit 120 presents a uniform film of ink to the photo imaging plate 110. The ink contains electrically-charged pigment particles which are attracted to the opposing charges on the image areas of the photo imaging plate 110. The photo imaging plate 110 then has a single colour ink image on its surface, i.e. an inked image or separation. In other implementations, such as those for black and white (monochromatic) printing, one or more ink developer units may alternatively be provided.

The ink may be a liquid toner, comprising ink particles and a carrier liquid. The carrier liquid may be an imaging oil. An example liquid toner ink is HP ElectroInk™. In this case, pigment particles are incorporated into a resin that is suspended in a carrier liquid, such as Isopar™. The ink particles may be electrically charged such that they move when subjected to an electric field. The ink particles may be negatively charged and are therefore repelled from negatively charged portions of photo imaging plate 110, and are attracted to the discharged portions of the photo imaging plate 110. The pigment is incorporated into the resin and the compounded particles are suspended in the carrier liquid. The dimensions of the pigment particles are such that the printed image does not mask the underlying texture of the print substrate, so that the finish of the print is consistent with the finish of the print substrate, rather than masking the print substrate. This enables liquid electrophotographic printing to produce finishes closer in appearance to offset lithography, in which ink is absorbed into the print substrate.

Returning to the printing process, the photo imaging plate 110 rotates as indicated by arrow 125 and transfers the ink image to a heatable intermediate transfer member 130, which rotates in a direction of arrow 135. In this example, the intermediate transfer member 130 includes a drum or cylinder part 132 and a transfer blanket (or 'print blanket') part 134. The transfer blanket 134 may be replaceable in that it may be removed from the drum or cylinder part 132 and replaced with the same or another transfer blanket. The transfer of an inked image from the photo imaging plate 110 to the intermediate transfer member 130 may be deemed the "first transfer". Following the transfer of the inked image onto the rotating and heated intermediate transfer member 130, the ink is heated by the intermediate transfer member 130. In some implementations, the ink may also be heated from an external heat source which may include an air supply. This heating causes the ink particles to partially melt and blend together. At the same time, at least some of the carrier liquid is evaporated and may be collected and reused.

Once the inked image has been transferred to the intermediate transfer member 130, it is transferred to a substrate 140 such as paper or plastic film. This transfer from the intermediate transfer member 130 to the print substrate 140 may be deemed the "second transfer". In one example, the substrate 140 is conductive and in another example the substrate 140 is non-conductive. An impression cylinder 145 can both mechanically compress the substrate 140 into contact with the intermediate transfer member 130 and also help feed the substrate 140.

As indicated above, a developed image may be transferred to the substrate 140, via the intermediate transfer member 130, which may have a replaceable transfer blanket 134. The intermediate transfer member 130 is heated to a temperature that causes the toner particles and residual carrier liquid to form a film in the printed areas. The film is then transferred to the substrate 140 by heat and pressure. The transfer blanket 134 may be a multi-layered intermediate transfer blanket for toner imaging including a thin, multi-layered, silicone-based image transfer layer and a base (or 'body') portion which supports the image transfer layer and provides the transfer blanket 134 with resilience during contact with a photo imaging plate 110 and/or a final substrate 140.

The transfer blanket 134 may have a release layer made of silicone rubber, for example, polydimethylsiloxane (PDMS). Current silicone-based release layers may have a limited lifespan. Repetitive swelling and drying of the silicone rubber layer may lead to degradation of the mechanical properties of the print blanket. Over time, this expansion and contraction of the silicone rubber layer, owing to iso-paraffinic oil swelling, may cause the transfer blanket 134 to be replaced, which is a time-consuming and expensive procedure.

Furthermore, silicone layers are susceptible to 'image memory', which is directly related to liquid absorption. After repeated printing cycles of the same image on the same area of a transfer blanket 134, a new task with other new images may be printed. Negative dot gain (NDG) or 'ghost memory' of the old image may be observed on a new printing task, where it is not supposed to be present. Therefore, negative dot gain memory manifests itself in subsequent printings by producing ghost images with decreased optical density or dot size and hence brighter visual appearance, as compared to the background, depending on the image which caused the dot gain memory. Hence, repetitive printing of the same image can affect the optical density memory of the transfer blanket 134 and/or photoreceptor and the effectiveness of transfer of small dots in images. This may be caused by uneven absorption of carrier liquid over the surface of the transfer blanket 134. The amount of carrier liquid that is absorbed at different portions of the transfer surface of the transfer blanket 134 may depend on whether those portions have toner particles or not. If a next colour separation has a different distribution of toner, then the next image may, under some circumstances, have varying amounts of toner transfer depending on the amount of liquid absorbed from the previous layer.

Different attempts have been made to solve dot gain memory failure of print blankets in liquid electrophotographic printing. The attempts have included advances in printing techniques as well as in the equipment and materials used.

For example, dot gain memory reduction may be achieved by changing an image location and/or orientation during the printing process on the transfer blanket 134. The image may for example be rotated 180° at a pre-determined frequency between prints. Images which are rotated are rotated again after affixation to a final substrate in order to harmonize the orientation of the printed output. In addition, the image location is moved longitudinally and/or laterally along the length of the transfer blanket. However, this method is complicated in practical use and has a limited success in decreasing negative dot gain memories.

Another equipment innovation that has been developed for addressing the negative dot gain memory issue involves the liquid toner formulations that are used.

Another attempted solution to the dot gain memory issue relates to the transfer blanket itself. A modified silicone release layer could be developed which decreases dot gain memory. For example, a very high concentration of conductive fillers (such as carbon black or carbon nanotubes) in the silicone release layer may help decrease dot gain memories. However, in practice, it has been found that a print blanket containing excessive amounts of conductive fillers in the silicone based layer, enough to significantly reduce dot gain memory, becomes ill-suited for liquid electrophotographic printing, exhibiting various print quality issues.

The present inventors have identified, unexpectedly, that an electrical discharge surface treatment, such as corona discharge application, could be used for example to address the dot gain issues in silicone-based release layers of LEP-suitable blankets. Other electrical discharge techniques including plasma treatment and mild intensity ozone treatment may also provide the same effect.

Returning again to FIG. 1, the example electrophotographic printer 100 described herein includes an electrical discharge member 150 to treat a transfer surface of the intermediate transfer member 130 using an electrical discharge surface treatment. The transfer surface may be the outwardly facing surface of the transfer blanket part 134 of the intermediate transfer member 130. In the examples that will now be described, the electrical discharge member 150 is a corona discharge member to treat the outwardly facing surface of the transfer blanket part 134 using a corona discharge technique.

It is known that in a variety of applications, PDMS-based surfaces may be modified to achieve improved surface energy or functionality. Tailoring a polymer with different properties at its surface and in the bulk may be used to increase wettability for its enhanced adhesion.

In this regard, corona discharge treatment has been used to modify PDMS surfaces by varying power, time, and electrode type. Corona treatment may be applied to modify a PDMS surface by the introduction of new functional groups, whereas the bulk composition and properties of the polymer are kept constant. Corona-treated PDMS surfaces show good wettability by polar liquids, leading to good adhesion.

Corona treatment propagates approximately several hundred nanometers under the silicone surface and causes chemical changes in the near surface region of PDMS. Degradation of the network structure in the formation of low molar mass cyclic and medium mass linear PDMS may take place. The increase in oxygen content in the surface leads to formation of hydrophilic SiOH (silanol) moieties and of SiO polar functional groups, called a 'silica-like' surface. A high density of silanol groups propagates their condensation to Si—O—Si bridges, and a silica-like surface layer can be formed.

These polar groups increase surface hydrophilic characteristics, surface energy and promote adhesion to polar substrates. However, the surface characteristics gradually change during ageing when noticeable hydrophobic recovery usually occurs in the first few hours after corona exposure ceases. Almost total recovery, for example from 50° to >100° water contact angle, can take over a hundred hours. This phenomenon is called hydrophobic recovery. It may be explained by the reorientation of polar groups from the surface to the bulk phase or the reorientation of nonpolar groups from the bulk to the outermost surface and by the diffusion of low-molecular weight silicone fluid from the bulk to the surface. Strong PDMS degradation processes result in the formation of low-molecular weight PDMS species. These oligomers have a high molecular mobility and can easily migrate to the sample surface over time.

In contrast to these known corona applications, mainly reflected by improved surface adhesion due to its more polar characteristics, the present inventors have identified a different application of the same physicochemical effect of corona discharge on the PDMS surfaces, as indicated above.

The present inventors have identified that dot gain memory prevention, or elimination of existing dot gain memory, may be achieved using corona treatment. Unexpectedly, the present inventors found that corona treatment conducted on the surface of an intermediate transfer member suitable for use in liquid electrophotographic printing, resulted in a significant benefit in reducing or even eliminating dot gain memory.

Corona treatment of the transfer surface of the transfer blanket even for several seconds may completely eliminate dot gain memory already seen with an aged blanket on earlier prints as a result of repetitive printing of the same image. An aged transfer blanket has a transfer surface that has not previously been used in the or another printing apparatus. In various example implementations according to the present disclosure, and which are described in more detail below, dot gain memory can be eliminated in subsequent printings after a short corona application of several seconds in the off-print mode. As used herein, the term "off-print mode" can refer to a mode in which the printing apparatus is not currently being used to print. Moreover, such short corona treatment in the off-print mode may prevent dot gain formation on a new printing blanket. A new transfer blanket has a transfer surface that has previously been used in the or another printing apparatus. Corona application on a new blanket silicone surface prevents dot gain memory formation after repetitive printing of the same image. Therefore, both in the case of prevention of dot gain memory on the prints with a new blanket and the case of elimination of existing dot gain memories with an aged blanket, corona treatment affects the optical density memory of the print blanket and/or photoreceptor and the effectiveness of transfer of small dots in images. Corona treatment may affect absorption of carrier liquid over the surface of the blanket. The improved functionality of the blanket surface to withstand dot gain memories may be due to the PDMS surface modification to achieve improved surface energy due to the oxidation of the upper silicone. Such surface modification by corona treatment, reflected by surface energy increase and new polar functional groups formation including hydrophilic SiOH (silanol) moieties and SiO polar functional groups, may have beneficial impact on eliminating or preventing dot gain formation.

The lifespan of blankets for liquid electrophotographic printing may be enhanced by improving dot gain memory failure.

Multiple electrical discharge surface treatments may be conducted on the transfer surface. For example, in order to prevent completely or reduce existing dot memories issue, multiple short (e.g. a few seconds) corona treatments may be applied intermittently or periodically on the blanket surfaces. The multiple electrical discharge surface treatments may be performed at intervals determined based on one or more conditions associated with the printing apparatus. For example, they may be based on printing task status, substrate condition and/or other process conditions associated with the printing apparatus 100. Such a multiple corona treatment procedure delays the described 'hydrophobic recovery' of PDMS and preserves its polar characteristics as a function of time. It was not previously known that such 'silica-like' surface formation might have any impact on dot gain formation or prevention in liquid electrophotographic printing. Therefore, a lifespan of the blanket can be increased by preventing or eliminating dot memory issue. Hence, the ability of the blanket silicone release layer to resist dot gain memory issue may be enhanced.

Returning now to FIG. 1, controller 155 controls part, or all, of the print process. For example, the controller 155 can control operation of the electrical discharge device 150 and can control the rotation of the ITM 130. It will be appreciated that the controller 155 can also control any other, or all of the components of the printer 100, however connections between those elements and the controller are not shown in FIG. 1 for clarity. Furthermore, controller 155 may also be embodied in one or more separate controllers.

Figure 2:
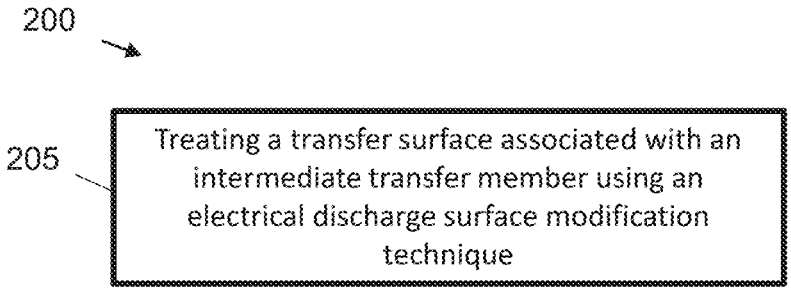
FIG. 2 is a flow diagram showing a method in accordance with an example.

FIG. 2 is a flow diagram showing a method 200.

At block 205, a transfer surface associated with an intermediate transfer member is treated using an electrical discharge surface treatment. The intermediate transfer member is in a printing apparatus.

Certain system components and methods described herein may be implemented by way of non-transitory computer program code that is storable on a non-transitory storage medium. In some examples, the controller 155 may comprise a non-transitory computer readable storage medium comprising a set of computer-readable instructions stored thereon. The controller 155 may further comprise at least one processor. Alternatively, one or more controllers 155 may implement all or parts of the methods described herein.

Figure 3:
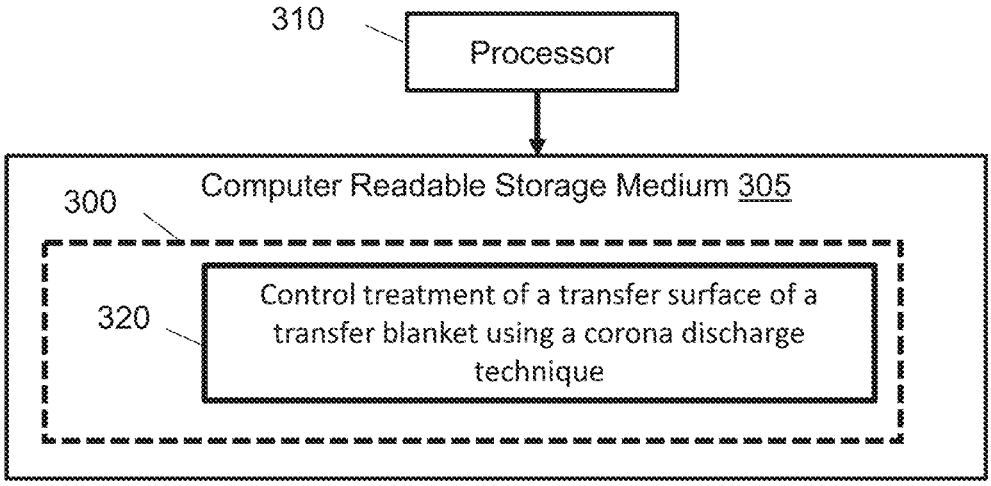
FIG. 3 is a schematic diagram showing an example set of computer-readable instructions within a non-transitory computer-readable storage medium in accordance with an example.

FIG. 3 shows an example of such a non-transitory computer-readable storage medium 305 comprising a set of computer readable instructions 300 which, when executed by at least one processor 310, cause the processor 310 to perform or control a method according to examples described herein. The computer readable instructions 300 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

In an example, instructions 300 cause the processor 310 in a liquid electrophotographic printer 100 to, at block 320, control treatment of a transfer surface of a transfer blanket using a corona discharge technique, the transfer blanket being in the liquid electrophotographic printer.

In one example procedure according to the present disclosure, physicochemical changes of the blanket release layer as a result of corona treatment were assessed. A surface of a liquid electrophotographic printing blanket can be treated with a portable corona discharge unit for 1 minute and the water contact angle and release layer surface tension were measured with a tensiometer. The contact angle of water dropped from 110° on the untreated silicone layer to 40° after corona treatment, while the surface tension increased from 19 millinewton per metre (mN/m) for the native silicone layer to 27 mN/m after corona treatment.

In a second example procedure, chemical changes of the blanket release layer as a result of corona treatment were assessed. A surface of a liquid electrophotographic printing blanket was treated with a portable corona discharge unit for 1 minute and attenuated total reflection-Fourier transform infrared (ATR-FTIR) measurements were performed in order to follow chemical changes on the surface.

Figure 4:
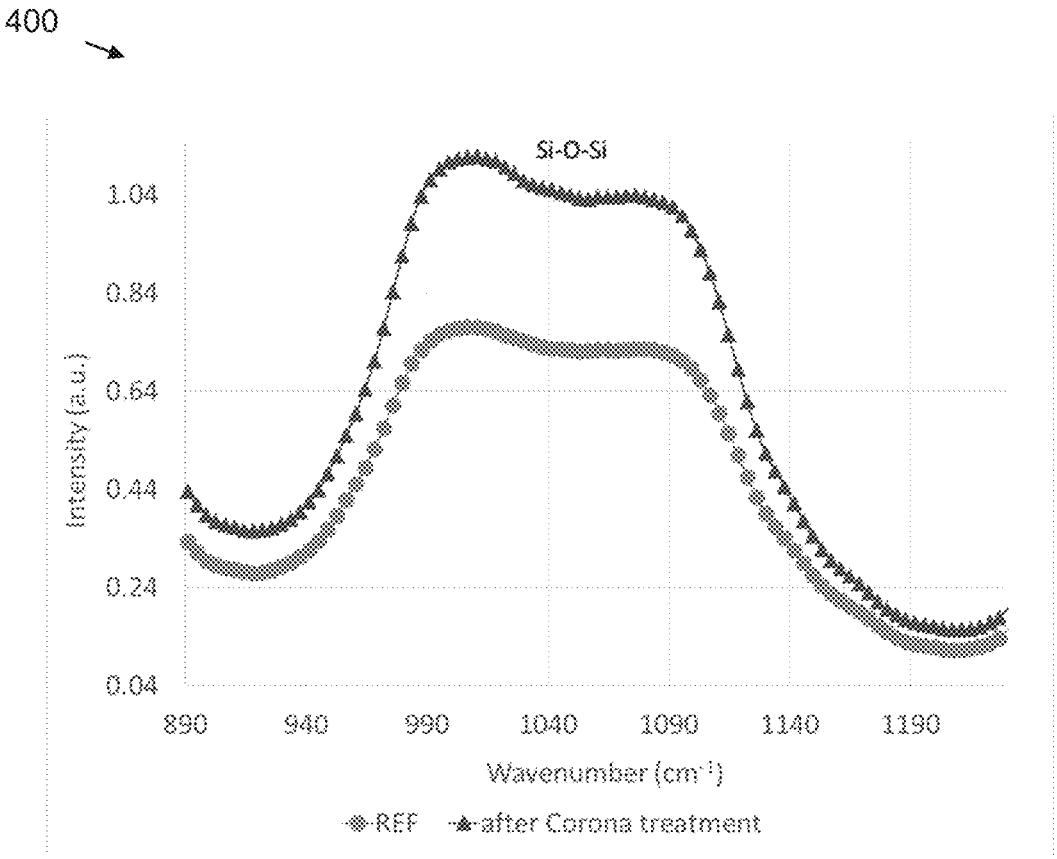
FIG. 4 is a graph showing intensity data relative to wavenumber according to an example.

FIG. 4 is a graph 400 showing intensity data relative to wavenumber. Graph 400 shows SiOx polar layer formation using data obtained in the second procedure. SiOx polar layer formation was detected by significant broadening of Si—O—Si peak (950-1200 $cm^{-1}$ range).

Figure 5:
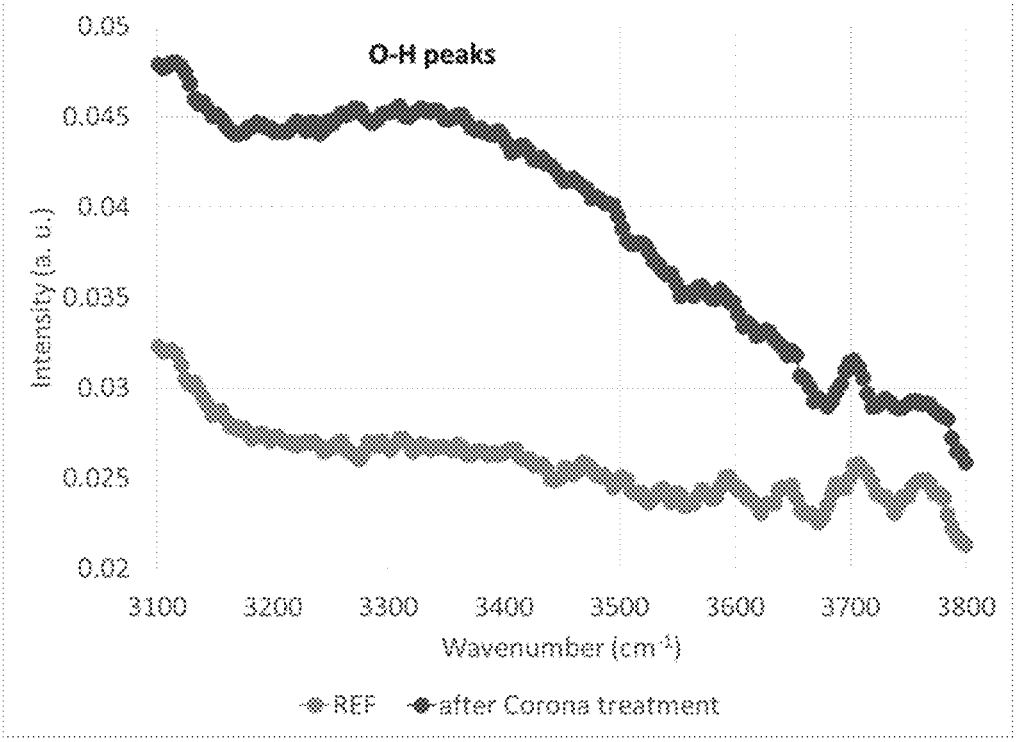
FIG. 5 is another graph showing intensity data relative to wavenumber according to an example.

FIG. 5 is a graph 500 showing intensity data relative to wavenumber. Graph 500 formation of hydroxyl groups and hydroperoxides using data obtained in the third procedure. Formation of hydroxyl groups (Si—C—C—OH) and hydroperoxides (Si—COOH) was recorded by observing a new peak formation at 3100-3800 $cm^{-1}$ range.

In a third procedure, elimination of dot gain memory from printing on an aged blanket using corona treatment was assessed.

Multiple copies of images comprising rectangular arrays were printed using a liquid electrophotographic printing blanket as a memory creator job, i.e. to create memory on the printing blanket. Afterwards, the printing task was changed to printing plain grey pages.

A print produced in the third procedure shows dot gain memory and negative dot memory was observed on the print. Subsequently, part of the printing blanket was treated with a portable corona discharge unit for 0.5 minutes.

Whilst no memory was detected on the print corresponding to the corona treated part of the blanket, strong negative dot gain memory appeared on the print part corresponding to the untreated part of the blanket.

In a fourth procedure, prevention of dot gain memory from print on a new blanket using corona treatment was assessed.

Part of a new printing blanket was treated with a portable corona discharge unit for 0.5 minutes. Afterwards, multiple copies of an image comprising black square arrays were printed using a printing blanket as 'a memory creator job', i.e. to create a memory. At that point, the printing task was changed to plain grey pages.

Negative dot memory was observed on the part of the print corresponding to the untreated part of the blanket, whilst almost no memory was detected on the part of the print corresponding to the corona-treated part of the blanket.

Various examples are described above in which the treating of the transfer surface has a duration of less than or equal to 1 minute. For example, the treating may be for a few seconds, 30 seconds or for a minute. Other treating times may be used.

Figure 6:
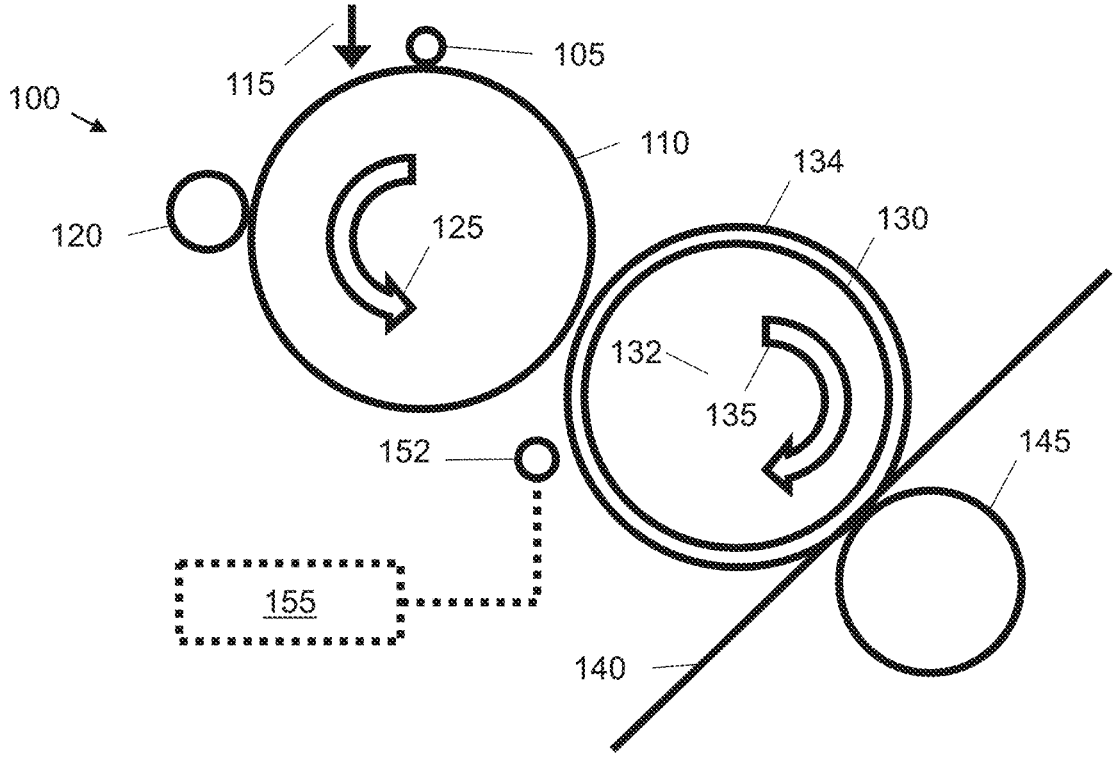
FIG. 6 is a schematic diagram showing a printing apparatus according to an example.

FIG. 6 shows a diagram similar to FIG. 1. In FIG. 6, the corona discharge member 152 is shown as an example of the electrical discharge member 150. The corona discharge member 152 is positioned so that the generated field from the corona discharge member 152 interacts with the surface of the intermediate transfer member 130.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method comprising for an intermediate transfer member that is incorporated in a printing apparatus, wherein a transfer surface has not previously been used in that printing apparatus or another printing apparatus, treating the transfer surface of an intermediate transfer member using an electrical discharge surface treatment.

2. A method according to claim 1, wherein using the electrical discharge surface treatment includes performing a corona discharge treatment on the transfer surface.

3. A method according to claim 1, wherein the treating has a duration of less than or equal to 1 minute.

4. A method according to claim 1, comprising performing multiple electrical discharge surface treatments on the transfer surface.

5. A method according to claim 4, wherein the multiple electrical discharge surface treatments are performed at intervals based on one or more conditions associated with the printing apparatus.

6. A method comprising:

for an intermediate transfer member that is incorporated in a printing apparatus that has been previously used in that or another printing apparatus, treating a transfer surface of the intermediate transfer member using an electrical discharge surface treatment during an off-print mode, wherein an off-print mode is a mode in which the printing apparatus is not currently being used to print.

7. A method according to claim 6, wherein using the electrical discharge surface treatment includes performing a corona discharge treatment on the transfer surface.

8. A method according to claim 6, wherein the treating has a duration of less than or equal to 1 minute.

9. A method according to claim 6, comprising performing multiple electrical discharge surface treatments on the transfer surface.

10. A method according to claim 9, wherein the multiple electrical discharge surface treatments are performed at intervals based on one or more conditions associated with the printing apparatus.

11. A method according to claim 6, wherein the intermediate transfer member comprises a transfer blanket and wherein the transfer surface is a surface of the transfer blanket.

12. A method according to claim 11, wherein the transfer blanket has a silicone-based release layer.

13. A method according to claim 12, wherein the silicone-based release layer comprises polydimethylsiloxane.

14. A method according to claim 6, wherein the printing apparatus is a liquid electrophotographic printing apparatus.

15. A method comprising, for an intermediate transfer member that is incorporated in a printing apparatus, treating a transfer surface of the intermediate transfer member using multiple electrical discharge surface treatments, wherein the multiple electrical discharge surface treatments are performed at intervals based on one or more conditions associated with the printing apparatus.

16. A method according to claim 15, wherein the transfer surface has previously been used in the printing apparatus or another printing apparatus.

17. A method according to claim 15, wherein the transfer surface has not previously been used in the printing apparatus or another printing apparatus.

18. A method according to claim 15, wherein the intermediate transfer member comprises a transfer blanket and wherein the transfer surface is a surface of the transfer blanket.

19. A method according to claim 18, wherein the transfer blanket has a silicone-based release layer comprising polydimethylsiloxane.

20. A method according to claim 15, wherein the printing apparatus is a liquid electrophotographic printing apparatus.

* * * * *